US011396890B2

(12) United States Patent
Beach et al.

(10) Patent No.: US 11,396,890 B2
(45) Date of Patent: Jul. 26, 2022

(54) MAGNETICALLY COUPLED SEALLESS CENTRIFUGAL PUMP

(71) Applicant: PSG CALIFORNIA LLC, Grand Terrace, CA (US)

(72) Inventors: Rex Warren Beach, Ontario, CA (US); Nicholas William Ortega, Riverside, CA (US); James Gregory Farley, Riverside, CA (US); Christopher Jon Distaso, Upland, CA (US)

(73) Assignee: PSG CALIFORNIA LLC, Grand Terrace, CA (US)

( * ) Notice: Subject to any disclaimer, the term of this patent is extended or adjusted under 35 U.S.C. 154(b) by 0 days.

(21) Appl. No.: 16/834,655

(22) Filed: Mar. 30, 2020

(65) Prior Publication Data

US 2020/0256340 A1 Aug. 13, 2020

Related U.S. Application Data

(63) Continuation of application No. 15/799,572, filed on Oct. 31, 2017, now Pat. No. 10,738,782.
(Continued)

(51) Int. Cl.
*F04D 29/62* (2006.01)
*F04D 13/02* (2006.01)
(Continued)

(52) U.S. Cl.
CPC ..... *F04D 29/622* (2013.01); *F04D 13/024* (2013.01); *F04D 13/026* (2013.01);
(Continued)

(58) Field of Classification Search
CPC ..... F04D 13/00; F04D 13/02; F04D 13/021; F04D 13/024; F04D 13/025;
(Continued)

(56) References Cited

U.S. PATENT DOCUMENTS 2,956,841 A 10/1960 Cametti et al.
3,877,844 A 4/1975 Klaus et al.
(Continued)

FOREIGN PATENT DOCUMENTS

CN 1035550 9/1989
CN 101251119 8/2008
(Continued)

OTHER PUBLICATIONS

International Search Report & Written Opinion re PCT/US17/59378, dated Jan. 26, 2018.
(Continued)

*Primary Examiner* — Charles G Freay
*Assistant Examiner* — Chirag Jariwala
(74) *Attorney, Agent, or Firm* — Fish & Richardson P.C.

(57) ABSTRACT

A magnetically driven centrifugal pump has a pump case, an open vane impeller in the pump case, a stuffing box including a stuffing box outer being fixed relative to the pump case and a stuffing box inner threadedly engaged with the stuffing box outer, and a rotor axially fixed and rotatably mounted in the stuffing box inner. Bushings are arranged between the rotor and the stuffing box inner. A drive is fixed relative to the pump case and includes a drive output extending into the rotor. There is a magnetic coupling between the rotor and the drive and a canister fixed to the stuffing box and extending through the magnetic coupling to isolate the rotor from the drive. A rub ring closes the end of the stuffing box inner and constrains the drive output from damaging the canister under catastrophic bearing failure.

7 Claims, 6 Drawing Sheets

Related U.S. Application Data

(60) Provisional application No. 62/416,059, filed on Nov. 1, 2016.

(51) Int. Cl.
*F04D 29/047* (2006.01)
*F04D 29/041* (2006.01)
*F04D 13/06* (2006.01)
*F04D 29/42* (2006.01)

(52) U.S. Cl.
CPC ..... *F04D 13/0606* (2013.01); *F04D 29/0413* (2013.01); *F04D 29/0473* (2013.01); *F04D 29/426* (2013.01); *F05B 2260/404* (2013.01)

(58) Field of Classification Search
CPC ..... F04D 13/026; F04D 13/027; F04D 13/06; F04D 13/0606; F04D 13/0626; F04D 13/0633; F04D 13/064; F04D 13/0673; F04D 25/00; F04D 25/02; F04D 25/026; F04D 25/06; F04D 25/0633; F04D 29/002; F04D 29/007; F04D 29/60–669; F04D 29/0413; F04D 29/0473; F04D 29/40; F04D 29/403; F04D 29/406; F04D 29/42; F04D 29/4206; F04D 29/4226; F04D 29/4233; F04D 29/426; F04D 13/0613; F04D 29/04; F04D 29/041; F04D 29/046; F04D 29/047; F04D 29/4293; F04D 13/0646; F04D 29/00
USPC ..... 417/420, 423.14
See application file for complete search history.

(56) References Cited

U.S. PATENT DOCUMENTS

| | | | | |
|---|---|---|---|---|
| 4,080,112 | A | 3/1978 | Zimmerman | |
| 4,645,433 | A * | 2/1987 | Hauenstein | F04D 29/167 415/105 |
| 4,661,044 | A | 4/1987 | Freeland | |
| 4,871,301 | A * | 10/1989 | Buse | F04D 13/026 417/420 |
| 5,368,439 | A | 11/1994 | Piazza | |
| 5,385,445 | A | 1/1995 | McKenna | |
| 5,501,582 | A * | 3/1996 | Gautier | F04D 13/025 415/110 |
| 5,547,299 | A | 8/1996 | Urban | |
| 5,779,449 | A | 7/1998 | Klein | |
| 5,846,049 | A * | 12/1998 | DuPuis | F04D 29/042 415/131 |
| 6,280,156 | B1 * | 8/2001 | Wirz | F04D 29/047 417/420 |
| 7,137,793 | B2 | 11/2006 | Shafer et al. | |
| 7,183,683 | B2 | 2/2007 | Shafer et al. | |
| 7,549,205 | B2 | 6/2009 | Shafter | |
| 8,162,630 | B2 | 4/2012 | Platt | |
| 10,240,600 | B2 | 3/2019 | Sandore et al. | |
| 10,738,782 | B2 | 8/2020 | Beach et al. | |
| 2003/0039544 | A1 * | 2/2003 | Yamazaki | F04D 13/0606 415/206 |
| 2010/0028176 | A1 | 2/2010 | Platt | |
| 2010/0280305 | A1 * | 11/2010 | Hidaka | F04D 29/047 600/16 |
| 2012/0177511 | A1 | 7/2012 | Sexton et al. | |
| 2015/0125324 | A1 * | 5/2015 | Sanford | F04D 29/526 415/220 |
| 2015/0260191 | A1 * | 9/2015 | Blankemeier | F04D 13/025 417/420 |
| 2016/0084256 | A1 * | 3/2016 | Drechsel | F04D 13/0626 417/420 |
| 2017/0175757 | A1 | 6/2017 | Shafer | |
| 2017/0191481 | A1 * | 7/2017 | Shafer | F04D 13/06 |
| 2018/0119698 | A1 | 5/2018 | Beach et al. | |

FOREIGN PATENT DOCUMENTS

| | | | | |
|---|---|---|---|---|
| CN | 101415950 | | 4/2009 | |
| CN | 101430188 | | 5/2009 | |
| CN | 201401342 | | 2/2010 | |
| CN | 201401343 | | 2/2010 | |
| CN | 202441610 | | 9/2012 | |
| CN | 104153999 | | 11/2014 | |
| CN | 104179693 | | 12/2014 | |
| CN | 104179693 | A * | 12/2014 | F04D 13/06 |
| CN | 104196763 | | 12/2014 | |
| CN | 105422471 | | 3/2016 | |
| CN | 205225759 | | 5/2016 | |
| DE | 298 22 717 | | 3/1999 | |
| DE | 29822717 | U1 * | 3/1999 | F01P 5/10 |
| GB | 2 263 312 | | 7/1993 | |
| JP | H01249998 | | 10/1989 | |
| JP | H11159492 | | 6/1999 | |
| TW | M527045 | | 8/2016 | |

OTHER PUBLICATIONS

Machine Translation of relevant portions of Abstract and Detailed Description of TWM527045, Aug. 11, 2016—Flow Engineering Corp.
English translation of Bibliographic Data of TWM527045, Aug. 11, 2016—Flow Engineering Corp.
Supplementary EU Search Report re App. 17867899.1-1007 / 3523539 dated Aug. 27, 2019.
EPO Examination Report re pp. 17867899.1-1007 dated Sep. 19, 2019.
European Extended Search Report in European Application No. 17867899.1, dated Sep. 3, 2019, 4 pages.
PCT International Search Report and Written Opinion in International Appln. No. PCT/US2017/059378, dated Jan. 26, 2018, 9 pages.
International Preliminary Report on Patentability in International Appln. No. PCT/US2017/059378, dated May 16, 2019, 8 pages.

* cited by examiner

MAGNETICALLY COUPLED SEALLESS CENTRIFUGAL PUMP

RELATED APPLICATIONS

This is a Continuation Application of U.S. application Ser. No. 15/799,572, filed Oct. 31, 2017, which claims priority to U.S. Provisional Application 62/416,059, filed Nov. 1, 2016, the disclosures of which is incorporated herein by reference in their entirely.

BACKGROUND OF THE INVENTION

The field of the present invention is pumps which are magnetically engaged.

Pumps that utilize an open/semi-open impeller need a means to adjust the impeller axially relative to the pump case. As the impeller and case wear over time, the clearance between the impeller and the case opens up. This degrades performance; the pump efficiency decreases; and the produced pump pressure can decrease. The impeller is then set to the appropriate clearance from the case during each maintenance cycle, using the external provisions of the pump, thereby not requiring the pump to be taken out of service. The concept of having a rotor that is externally adjustable is industry standard for normal sealed pumps. The mechanisms accompanying axial adjustment in a sealed pump are generally located in the power frame. This is possible with a sealed pump because the impeller is mechanically connected to the ball bearings (in the power frame) through the shaft, etc.

Other features are commonly employed. Shunted process fluid is frequently used for lubrication of bearing surfaces. In magnetically coupled sealless pumps, the bearing surfaces and the interior magnets of the magnetic coupling conventionally are wetted, while the exterior magnets are in atmosphere. Such arrangements require bearing and magnetic mountings on multiple elements.

Rub rings are commonly employed with a component to restrict eccentric rotation upon catastrophic bearing failure. Such rotation can damage sealing canisters. Plates are also used to protect workers from catastrophic component failure. Often, component complexity in arranging these and other details is dictated in magnetically coupled pumps by the pump drive being concentrically outwardly of the driven rotor assembly, usually including an impeller shaft.

SUMMARY OF THE INVENTION

The present invention is directed to a magnetically driven centrifugal pump including a pump case, an impeller, a stuffing box and magnetic coupling between an impeller rotor and a drive. A canister extends through the magnetic coupling to form a barrier between the impeller rotor side and the drive side of a pump.

The stuffing box includes a stuffing box outer fixed to the pump case and a stuffing box inner threadedly engaged with the stuffing box outer about the axis of impeller rotation. The impeller rotor is axially fixed relative to the stuffing box inner. Rotation of the stuffing box inner relative to the stuffing box outer can then adjust the impeller clearance in the pump case.

An annular rotor bushing may be between the rotor and the stuffing box inner; an annular impeller bushing may be between the impeller hub and the stuffing box inner and two opposed thrust bushings are between the stuffing box inner and the rotor. All may be mounted exterior to the drive. This common access simplifies the stuffing box and facilitates ease of service.

Accordingly, it is an object of the present invention to provide an improved magnetically coupled centrifugal pump. Other and further objects and advantages will appear hereinafter.

DETAILED DESCRIPTION OF THE PREFERRED EMBODIMENTS

Figure 1:
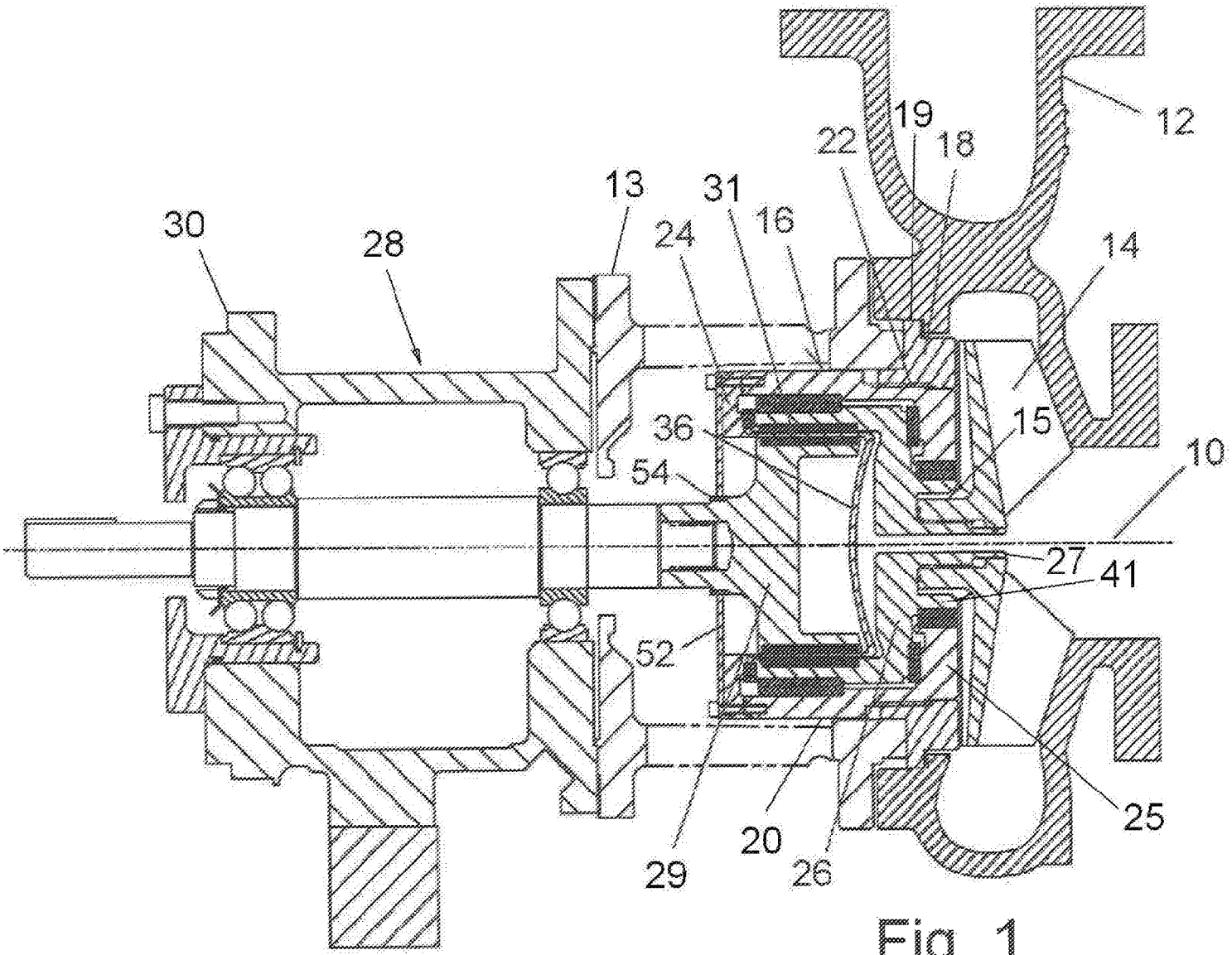
FIG. 1 is a cross-sectional elevation of a magnetically driven centrifugal pump taken through the axis of impeller rotation.

Turning in detail to the drawings, the Figures each show the surface of sections through the access of impeller rotation 10. The major components except for the pump case and the pump housing, which are asymmetrical because of volutes and mountings, respectively, are substantially symmetrical about the axis of impeller rotation. The first embodiment, FIGS. 1 through 3, differ from the second embodiment, FIGS. 4 through 6, by the support arrangements for the impeller. In both embodiments, a bushing is about the hub of the impeller to securely support the rotatable impeller.

A pump case 12 defining an impeller cavity and a volute is further defined by a housing structure 13. The pump case 12 surrounds an open vane impeller 14 while the housing structure 13 extends over a stuffing box 16. The impeller 14 includes an impeller hub 15 extending away from the vanes of the impeller 14. The pump case 12 and housing structure 13 are conventionally assembled with bolts. The housing structure 13 is shown in this instance to have an open arrangement with holes about the circumference.

The stuffing box 16 includes a stuffing box outer 18 which is a collar with an outer flange 19 engaging the pump case 12 and held in place by the housing structure 13. The stuffing box 16 further includes a stuffing box inner 20 engaged with the stuffing box outer 18 at a threaded engagement 22. The threaded engagement 22 provides for the stuffing box inner 20 to be rotated relative to the stuffing box outer 18 to allow axial translation of the stuffing box inner 20 relative to the stuffing box outer 18 and in turn the pump case 12. After the desired axial position of the stuffing box inner 20 is achieved, the rotational position of the stuffing box inner can either be held by thread friction or by an external set screw. The stuffing box inner 20 extends from the threaded engagement 22 as a cylinder to a stuffing box inner detachable cap 24. The stuffing box inner detachable cap 24 is held in place by fasteners.

A rotor 26 is located within the annular cavity defined within the stuffing box inner 20. The rotor 26 is also cylindrical with a front wall. A mounting hub 27 fixed on the cylindrical front wall threadedly engages the impeller hub 15 so that the impeller 14 is detachably fixed to the rotor 26.

With the rotor 26 located in the annular cavity with thrust bushings described below, the rotor 26 moves axially with the stuffing box inner 20 relative to the stuffing box outer 18. With the stuffing box outer 18 engaging the pump case 12 and the rotor 26 being engaged through the mounting hub 27 with the impeller hub 15, the axial adjustment of the stuffing box inner 20 relative to the stuffing box outer 18 is used to create an appropriate clearance between the impeller 14 and the pump case 12.

A drive 28 is arranged inwardly of the rotor 26. The drive 28 includes a drive output 29 that is cylindrical with an engagement to receive a drive shaft coupled with a motor (not shown) for torque transfer. The drive further includes a drive shaft power frame 30 with a shaft conventionally arranged in with bearings as shown to transfer rotary power from the motor. The housing is conventionally coupled with the housing structure 13 by bolts.

Power to the rotor 26 from the drive 28 is transmitted through a magnetic coupling 31. The magnetic coupling 31 is traditional including driving magnets 32 associated with the drive 28 and driven magnets 34 associated with the rotor 26. A canister 36 extends through the magnetic coupling. The canister 36 is integrally formed with the stuffing box inner detachable cap 24. The stuffing box inner detachable cap 24 and the associated canister 36 are retained by fasteners at the end of the stuffing box inner 20. Thus, the canister 36 does not rotate with either the rotor 26 or the drive 28 but remains stationary in the pump unless the impeller 14 is being axially adjusted. The canister 36 includes a concave end which results in less distortion of the canister 36 under pressure loads from the pump process fluids.

Figure 2:
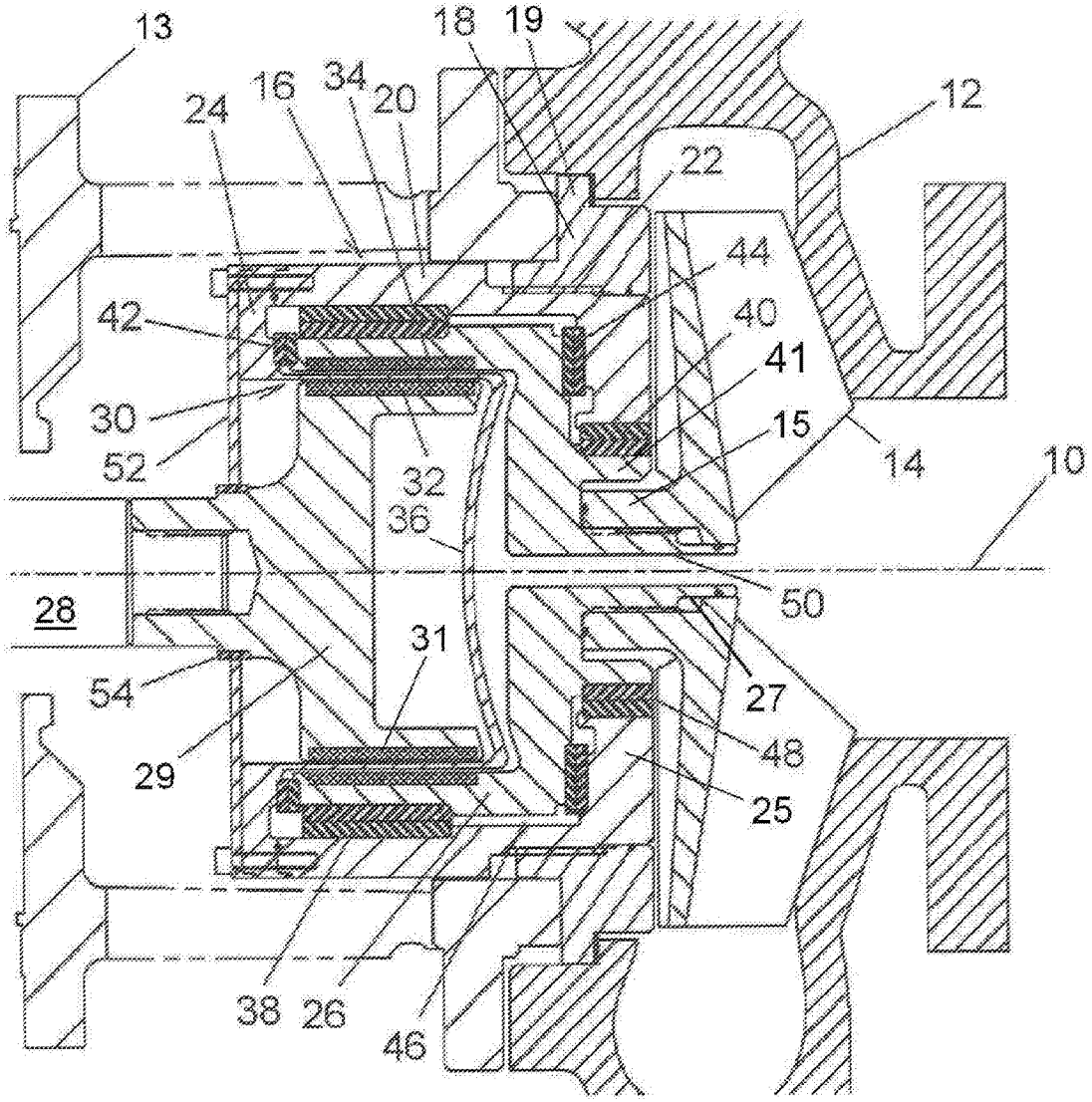
FIG. 2 is a cross-sectional detail of the stuffing box illustrated in FIG. 1.
Figure 3:
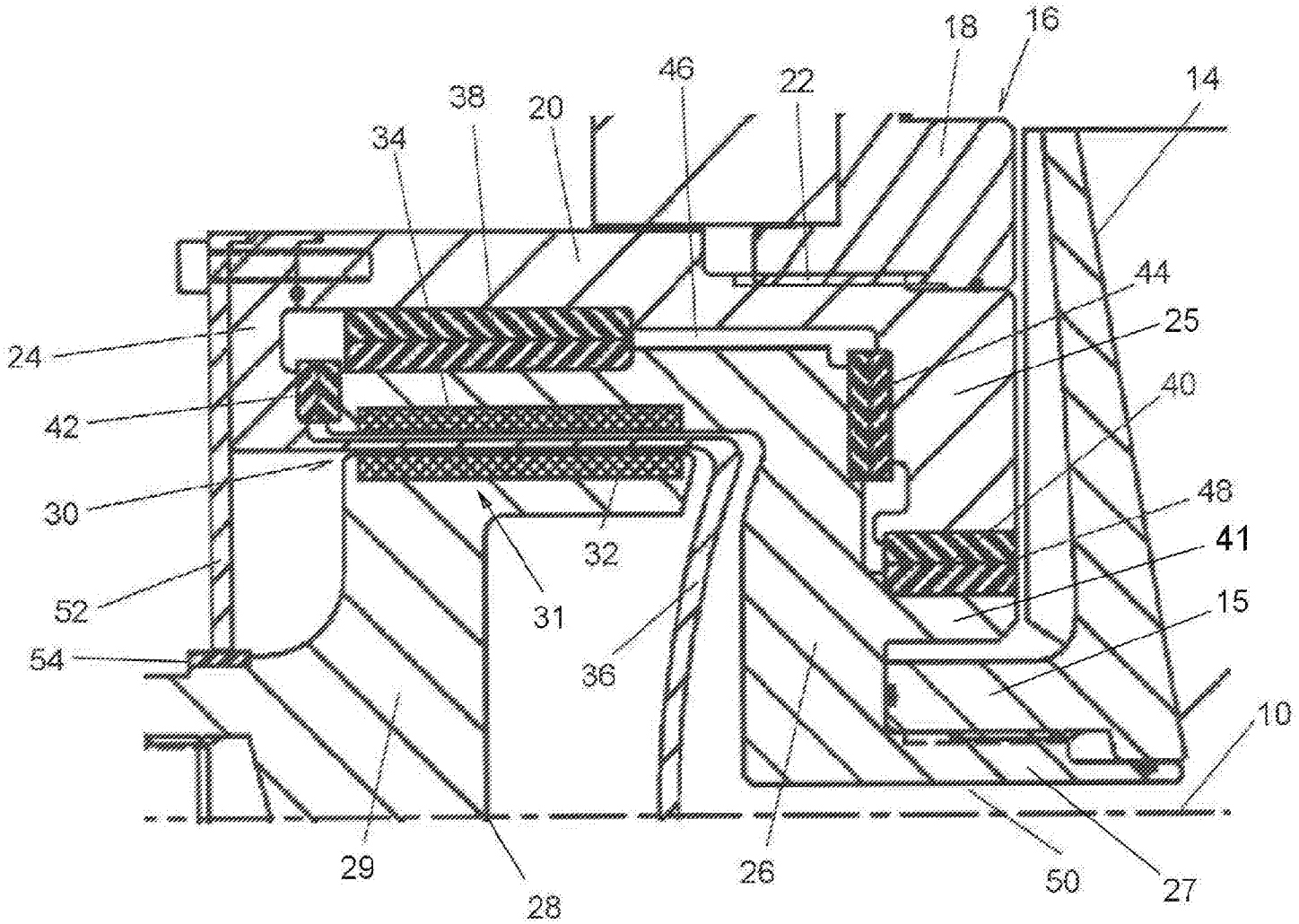
Figure 4:
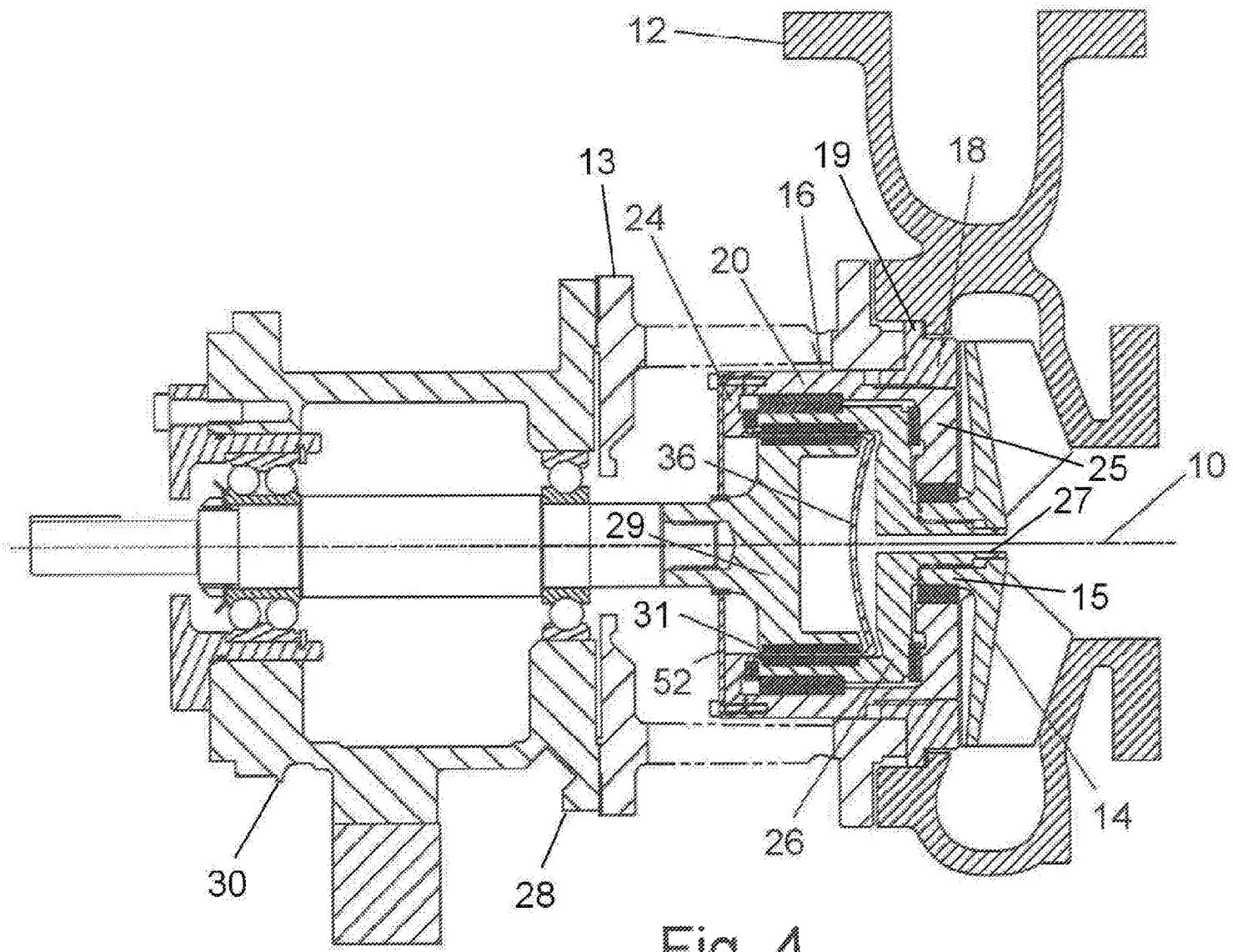
FIG. 4 is a cross-sectional elevation of a second embodiment of a magnetically driven centrifugal pump taken through the axis of impeller rotation.
Figure 5:
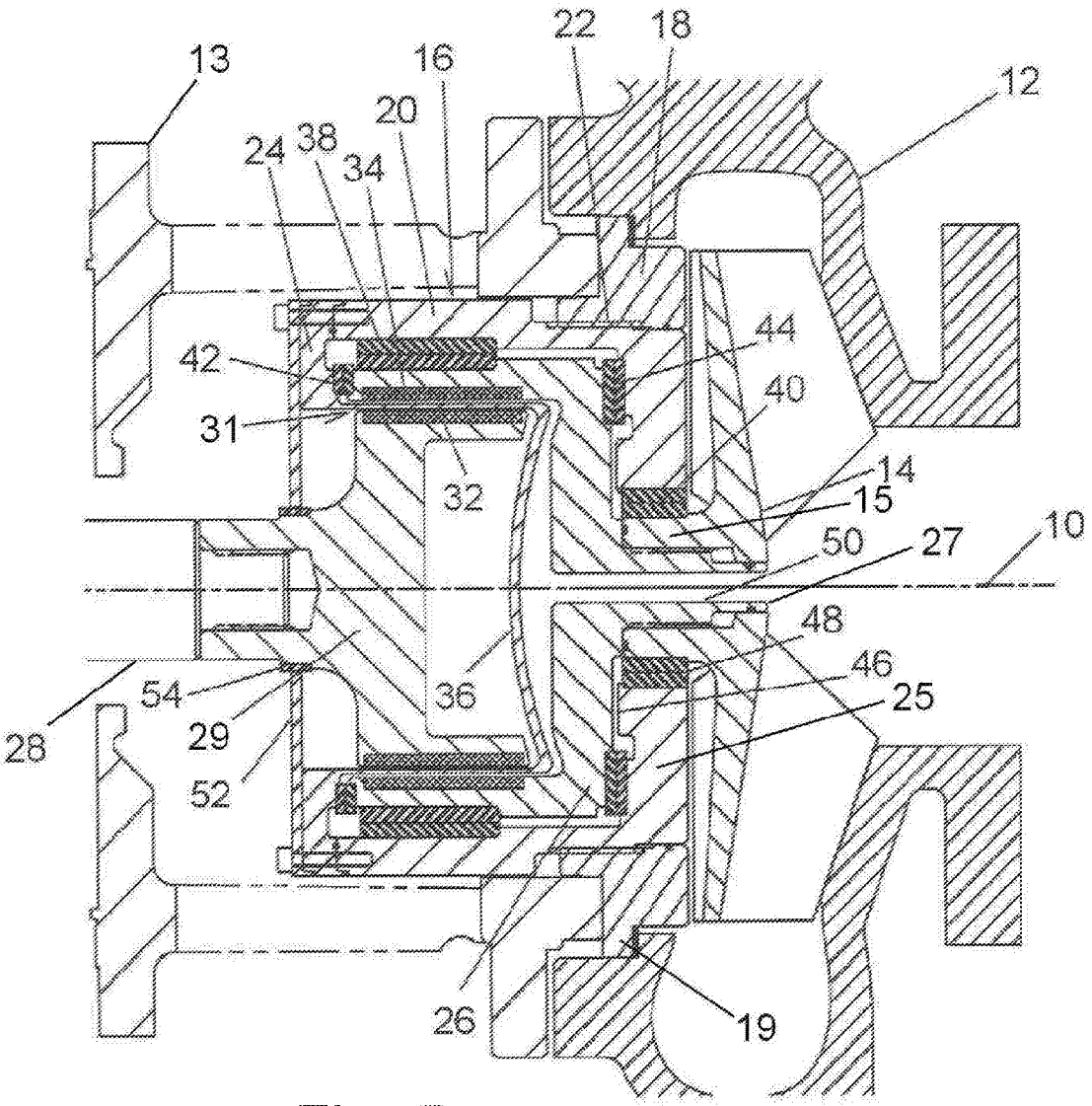
FIG. 5 is a cross-sectional detail of the stuffing box illustrated in FIG. 4.
Figure 6:
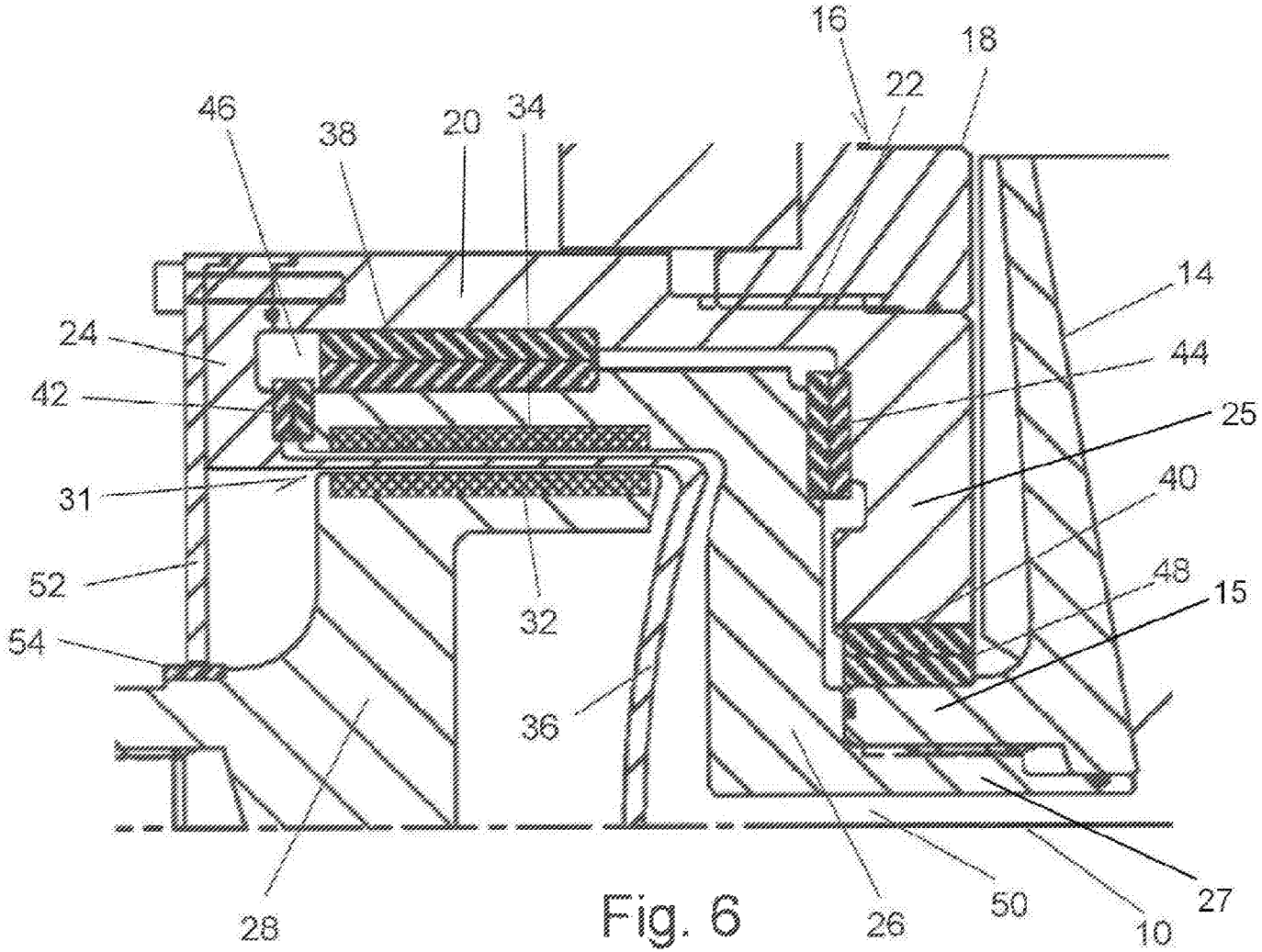
FIG. 6 is a detail of the magnets and bushings in the stuffing box of FIG. 5.

In the preferred embodiment, the rotating components within the stuffing box 16 are mounted through bushings. The bushings used in these embodiments are bushing pairs each with a static bushing associated with the stuffing box inner 20 and a dynamic bushing each associated with the rotor/impeller assembly 26/14. These components are held in place by conventional means. An annular rotor bushing 38 is located between the stuffing box inner 20 and the rotor 26. The annular impeller bushing 40 is between the stuffing box inner 20 and the impeller hub 15. In the first embodiment as illustrated in FIGS. 1 through 3, the mounting hub 27 includes an outer ring 41. The annular impeller bushing 40 is engaged with the mounting hub 27. This arrangement thus allows engagement of all of the bushings with the rotor 26. At the same time, the annular impeller bushing 40 remains between the stuffing box inner 20 and the impeller hub 15 to positively mount the impeller 14. In the second embodiment, as seen in FIGS. 4 through 6, the bushing 48 directly engages the impeller hub 15 to the same end. With either arrangement, the rotor 26 is rotationally mounted by the annular rotor bushing 38 and the annular impeller bushing 40 within the stuffing box inner 20.

A forward thrust bushing 42 is arranged between the stuffing box inner detachable cap 24 and the rotor 26. A rearward thrust bushing 44 is located between the stuffing box wall 25 and the rotor 26. The thrust bushings 42, 44 thus retain the rotor 26 fixed axially within the stuffing box inner 20. Again, all of the annular and thrust bushings are traditionally placed within the pump.

A process fluid shunt 46 lubricates the bushings located about the rotor. A shunt inlet 48 is located outwardly of the impeller hub 15 to extend through the annular impeller bushing 40. A gap between the rotor 26 and the stuffing box wall 25 directs process fluid through the rearward thrust bushing 44. An annular gap between the stuffing box inner 20 and the rotor 26 then permits the shunted process fluid to move to and through the annular rotor bushing 38. An annular cavity adjacent the annular rotor bushing 38 defined in the stuffing box inner detachable cap 24 then directs the shunted process fluid through the forward thrust bushing 42. The shunted process fluid is then released to around the canister 36 where it passes by the wetted magnets 34 and then to the shunt return 50 along the access of impeller rotation 10. The shunt inlet 48 is located outwardly on the open vane impeller 14 of the shunt return 50 located along the access of impeller rotation 10. Thus, rotation of the impeller 14 is able to drive circulation of the shunted process fluid.

A rub ring 52 closes the drive end of the stuffing box inner 20 by extending inwardly to the drive 28. In addition to closing the stuffing box inner 20, the rub ring 52 is associated with a circumferential ring 54 located on the drive 28. The maximum compressive deformation in the ring 54 is less than the gap between the canister 36 and either of the magnet assemblies 32, 34. This prevents damage to the canister 36 by catastrophic failure of any of the bearings.

Thus, an improved magnetically coupled centrifugal pump is shown and described. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A magnetically driven centrifugal pump having an axis of impeller rotation, the magnetically driven centrifugal pump comprising:

a pump case;

an open vane impeller in the pump case rotatably mounted about the axis of impeller rotation;

a stuffing box including a stuffing box outer being fixed relative to the pump case and a stuffing box inner accessible from outside the pump to rotate the stuffing box inner, the stuffing box outer including a first thread fixed relative to the stuffing box outer and extending in a circumferential direction about the axis of impeller rotation, the stuffing box inner including a respective second thread threadedly engaged with the first thread and thereby forming a threaded connection with the first thread, the second thread fixed relative to the stuffing box inner and extending in the circumferential direction about the axis of impeller rotation;

a rotor axially fixed and rotatably mounted about the axis of impeller rotation in the stuffing box inner, the impeller being fixed to rotate with the rotor, the rotor axially movable by the stuffing box inner as the stuffing box inner is rotated to adjust a clearance between the impeller and the pump case;

a drive including a drive end rotatably mounted about the axis of impeller rotation, the drive end disposed at least partially inside the rotor;

a magnetic coupling defined between an internal surface of the rotor and an external surface of the drive end; and a canister fixed to the stuffing box inner and extending between the drive and the rotor through the magnetic coupling to isolate the rotor from the drive and prevent a process fluid from flowing from the stuffing box to the drive.

2. The magnetically driven centrifugal pump of claim 1, wherein the rotor is concentric with and outwardly of the drive end at the magnetic coupling in the stuffing box.

3. The magnetically driven centrifugal pump of claim 2, further comprising:

a journal rotor bushing between the rotor and the stuffing box inner;

a journal impeller bushing aligned radially between the impeller and the stuffing box inner; and two opposed thrust bushings, a first of the thrust bushings being between and bearing on both the stuffing box inner and the rotor.

4. The magnetically driven centrifugal pump of claim 3, wherein the rotor defines, with the stuffing box inner, a process fluid shunt therebetween configured to direct the process fluid to the journal rotor bushing, lubricating the journal rotor bushing.

5. The magnetically driven centrifugal pump of claim 1, wherein the rotor comprises a mounting hub attached to an impeller hub of the impeller.

6. The magnetically driven centrifugal pump of claim 5, wherein the mounting hub comprises a shunt return bore configured to direct the process fluid from about the canister to the impeller.

7. The magnetically driven centrifugal pump of claim 6, wherein the rotor defines, with the stuffing box inner, a first gap therebetween configured to direct the process fluid from the impeller to a detachable cap of the stuffing box inner, and the rotor defines, with the canister, a second gap therebetween configured to direct the process fluid from the detachable cap of the stuffing box inner to the shunt return bore of the rotor.

* * * * *